US007289744B2

(12) United States Patent
Shirakata et al.

(10) Patent No.: US 7,289,744 B2
(45) Date of Patent: Oct. 30, 2007

(54) IMAGE FORMING APPARATUS

(75) Inventors: Jiro Shirakata, Kashiwa (JP); Koji Takematsu, Abiko (JP); Hisashi Otaka, Toride (JP); Kohei Koshida, Toride (JP); Kenichi Manabe, Tokyo (JP); Hideaki Miyazawa, Abiko (JP); Hideaki Kosasa, Abiko (JP); Yuji Yamanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 11/295,654

(22) Filed: Dec. 7, 2005

(65) Prior Publication Data

US 2006/0120744 A1 Jun. 8, 2006

(30) Foreign Application Priority Data

Dec. 7, 2004 (JP) ..... 2004-353841

(51) Int. Cl.
*G03G 15/20* (2006.01)

(52) U.S. Cl. ..... 399/67; 399/23; 399/68; 399/315

(58) Field of Classification Search ..... 399/68, 399/23, 315
See application file for complete search history.

(56) References Cited

U.S. PATENT DOCUMENTS

| | | | | |
|---|---|---|---|---|
| 5,758,252 | A | 5/1998 | Enomoto et al. | 399/407 |
| 6,892,038 | B2 * | 5/2005 | Fukutani | 399/68 |
| 2003/0117673 | A1 | 6/2003 | Yamanaka | 358/498 |
| 2005/0128536 | A1 | 6/2005 | Yamanaka et al. | 358/488 |
| 2006/0051116 | A1 | 3/2006 | Koshida | 399/68 |
| 2006/0086727 | A1 | 4/2006 | Takematsu et al. | 219/619 |
| 2006/0088333 | A1 | 4/2006 | Watanabe et al. | 399/107 |
| 2006/0222386 | A1 | 10/2006 | Koshida et al. | 399/44 |
| 2006/0222394 | A1 | 10/2006 | Koshida | 399/68 |
| 2006/0263128 | A1 | 11/2006 | Takematsu et al. | 399/401 |

FOREIGN PATENT DOCUMENTS

| | | |
|---|---|---|
| JP | 5-165654 | 12/1981 |
| JP | 5-107966 | 4/1993 |
| JP | 9-90685 | 4/1997 |
| JP | 11-174858 | 7/1999 |
| JP | 2002-182491 | 6/2002 |
| JP | 2002-311728 | 10/2002 |

* cited by examiner

*Primary Examiner*—David M. Gray
*Assistant Examiner*—David A Blackshire
(74) *Attorney, Agent, or Firm*—Fitzpatrick, Cella, Harper & Scinto

(57) ABSTRACT

An image forming apparatus includes an electrode member to prevent the generation of an image defect in the image forming apparatus, in which the electrode member is provided in the downstream side of a transfer device, the transfer device and a fixing device are arranged while brought close to each other, and the sheet is sandwiched by the fixing device while sandwiched and conveyed by an image bearing device and the transfer device.

6 Claims, 10 Drawing Sheets

(a)

(b)

(a)

(b)

(a)

(b)

(c)

IMAGE FORMING APPARATUS

BACKGROUND OF THE INVENTION

1. Field of the Invention

The present invention relates to an image forming apparatus, particularly to the image forming apparatus having a process, in which an unfixed image is transferred with toner to a sheet such as paper in transfer means and then the sheet is conveyed to fixing means to fix the unfixed image.

2. Description of the Related Art

Conventionally, in the image forming apparatus which forms an image with a developer including toner, a latent image is formed on a photosensitive member, the latent image is developed with the toner to transfer the developed image to a, sheet (recording material), and then the image is formed by heating and pressurizing the transferred image with a fixing device. Examples of the image forming apparatus which obtains a color image with the pieces of toner having plural colors include the image forming apparatus in which a color toner image primary-transferred to an intermediate transfer member in a superposing manner is collectively secondary-transferred to the sheet and the image forming apparatus in which each color toner image is sequentially transferred to the sheet in the superposing manner.

FIG. 8A to 8C is a view showing a transfer unit in which an intermediate transfer member is used and a neighborhood of the transfer unit. Referring to FIG. 8A, the toner image on a photosensitive drum 30 is primary-transferred in a superposing manner to an intermediate transfer belt (image bearing member) 35 which is an example of the intermediate transfer member. The color toner image on the intermediate transfer belt 35 is secondary-transferred in a collective manner to a sheet 100 by a transfer roller 39 which is an example of the transfer means. A predetermined bias voltage is applied between the transfer roller 39 and a transfer opposing roller 38 which is an example of a roller straining the intermediate transfer belt 35 by power supply means (not shown).

The sheet 100 to which the toner image is transferred is conveyed to a heating and fixing device 36 which is an example of the fixing means, and the image is fixed by applying heat and pressure with a fixing roller 44 and a pressure roller 45. A guide member 43 and a charge removal needle 42 are arranged between a transfer nip portion (pressure contact point of intermediate transfer belt 35 and transfer roller 39) and a fixing nip portion (pressure contact point of fixing roller 44 and pressure roller 45). The guide member 43 guides the sheet 100 to the fixing nip portion, and the charge removal needle 42 which is an example of an electrode member removes a charge on the charged sheet 100.

As shown in FIG. 8B, a front end portion of the sheet 100 conveyed in the transfer nip portion is guided to reach the fixing nip portion by the guide member 43. In order to achieve miniaturization of the image forming apparatus, a linear distance between the centers of the transfer nip portion and the fixing nip portion is set not more than 80 mm in a direction in which the sheet 100 is conveyed. Accordingly, as shown in FIG. 8C, the sheet 100 form a loop while sandwiched and conveyed by both the transfer nip portion and the fixing nip portion, and the transfer process, the charge removal process, and fixing process are simultaneously performed.

However, in the image forming apparatus shown in FIG. 8, a difference between a speed at which the sheet is conveyed in the transfer nip portion and a speed at which the sheet is conveyed in the fixing nip portion causes a change in loop state formed between the transfer means and the fixing means. The distance between the sheet and the electrode member is also changed as the loop state is changed, which causes a problem that an image defect is generated.

SUMMARY OF THE INVENTION

An object of the invention is to stabilize the distance between the sheet and the electrode member to prevent the generation of the image defect in the image forming apparatus, in which the electrode member is provided in the downstream side of the transfer means, the transfer means and the fixing means are arranged while brought close to each other, and the sheet is sandwiched by the fixing means while sandwiched and conveyed by the image bearing member and the transfer means.

Another object of the invention is to provide an image forming apparatus including an image forming apparatus including an image bearing member which bears a toner image; transfer means which forms a transfer nip portion while being in contact with the image bearing member, which sandwiches and conveys a recording material with the image bearing member in the transfer nip portion, which transfers the toner image to the recording material; fixing means in which the recording material is sandwiched and conveyed in a fixing nip portion where a first fixing member and a second fixing member are in contact with each other, the fixing means which fixes the toner image to the recording material; and an electrode member which is provided between the transfer means and the fixing means, wherein the recording material is sandwiched and conveyed by the fixing means while sandwiched and conveyed by the transfer means, a length d (mm) of a shortest straight line connecting a center of the transfer nip portion and a center of the fixing nip portion in a direction in which the recording material is conveyed satisfies $0\ (\text{mm}) < d <= 80\ (\text{mm})$, and wherein assuming that an angle formed by the shortest straight line and a tangent being in contact with the transfer means in the center of the transfer nip portion is $\phi$ (rad), a distance between the center of the transfer nip portion and a position nearest to the recording material of the electrode member is j (mm) in the direction parallel to the tangent being in contact with the transfer means, a maximum length of the recording material is P (mm) in the direction in which the recording material is conveyed, a speed at which the recording material is conveyed by the transfer means is V (mm/sec), and a maximum speed difference generated between the speed V (mm/sec) and a speed at which the recording material is conveyed by the fixing means is $\Delta V$ (mm/sec), the angle $\phi$ satisfies $0 < j \times ABS(\phi - ACOS(d/(d/COS\ \phi + (P-d/COS\ \phi) \times \Delta V/V))) <= 1$ (mm), where ABS is a function which determines an absolute value and ACOS is an inverse function of COS.

DESCRIPTION OF THE PREFERRED EMBODIMENT

Figure 1:
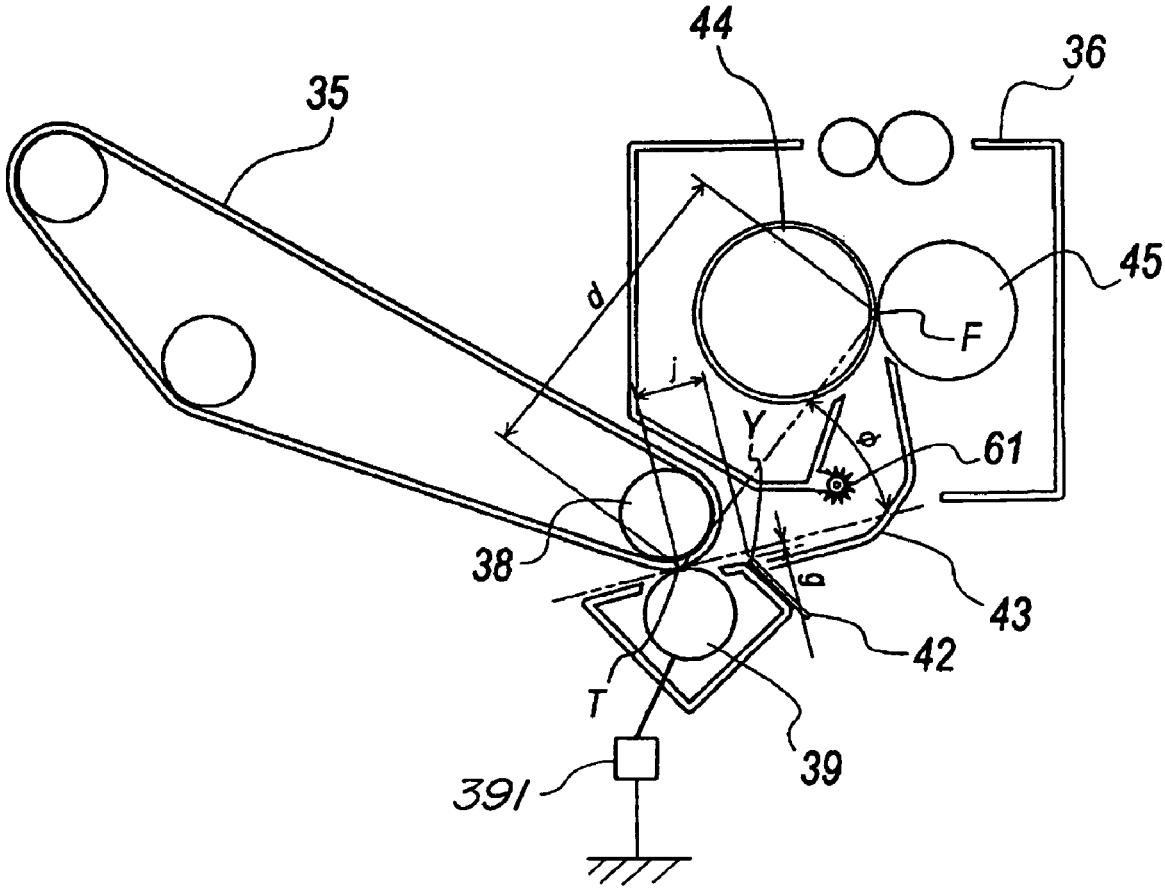
FIG. 1 is a view explaining a transfer unit and its neighborhood in an image forming apparatus according to a first embodiment.

In the present invention, assuming that the length of the shortest straight line connecting the center of the transfer nip portion and the center of the fixing nip portion is d (mm), the angle formed by the shortest straight line and the tangent being in contact with the transfer means in the center of the transfer nip portion is ϕ (rad), the distance between the center of the transfer nip portion and the position nearest to the recording material of the electrode member is j (mm) in the direction parallel to the tangent being in contact with the transfer means, the maximum length of the recording material is P (mm) in the direction in which the recording material is conveyed, the speed at which the recording material is conveyed by the transfer means is V (mm/sec), and the maximum value of the speed difference generated between the speed V (mm/sec) and the speed at which the recording material is conveyed by the fixing means is ΔV (mm/sec), the image defect caused by the change in distance between the charge removal needle and the sheet can be prevented by satisfying $$0<j\times ABS(\phi-\mathrm{ACOS}(d/(d/\mathrm{COS}\ \phi+(P-d/\mathrm{COS}\ \phi)\times \Delta V/V)))<=1\ (\mathrm{mm}),$$

where ABS is a function which determines an absolute value and ACOS is an inverse function of COS.

In the sheet which is sandwiched and conveyed by the two of upstream and downstream roller pairs, when the conveyance speeds of the upstream and downstream roller pairs are completely equal to each other, the sheet is conveyed while an initial loop amount is kept. However, when a speed difference exists between the upstream and downstream roller pairs, the loop amount is changed every moment. That is, as shown in FIG. 8C, for the sheet 100 which is conveyed in an initial loop P0, the loop is decreased as shown by a loop amount P1 of FIG. 8C when the conveyance speed of a downstream fixing roller 44 is faster than that of an upstream transfer roller 39. On the contrary, when the conveyance speed of the upstream transfer roller 39 is faster than that of the downstream fixing roller 44, the loop is increased as shown by a loop amount P2.

When the loop amount is changed, a gap g between the sheet 100 and a charge removal needle 42, that is, the gap g the sheet 100 and a position (hereinafter referred to as "charge removal needle point") Y nearest to the sheet 100 of the charge removal needle 42 is changed. Because charge removal performance of the charge removal needle 42 largely depends on a distance to a subject, a charge removal state is also changes when the gap g is changed, which causes the problem that various image defects are generated. When a change amount Δg of gap g between the charge removal needle 42 and the sheet 100 exceeds 1 mm, the defects on the image become conspicuous.

Figure 8:
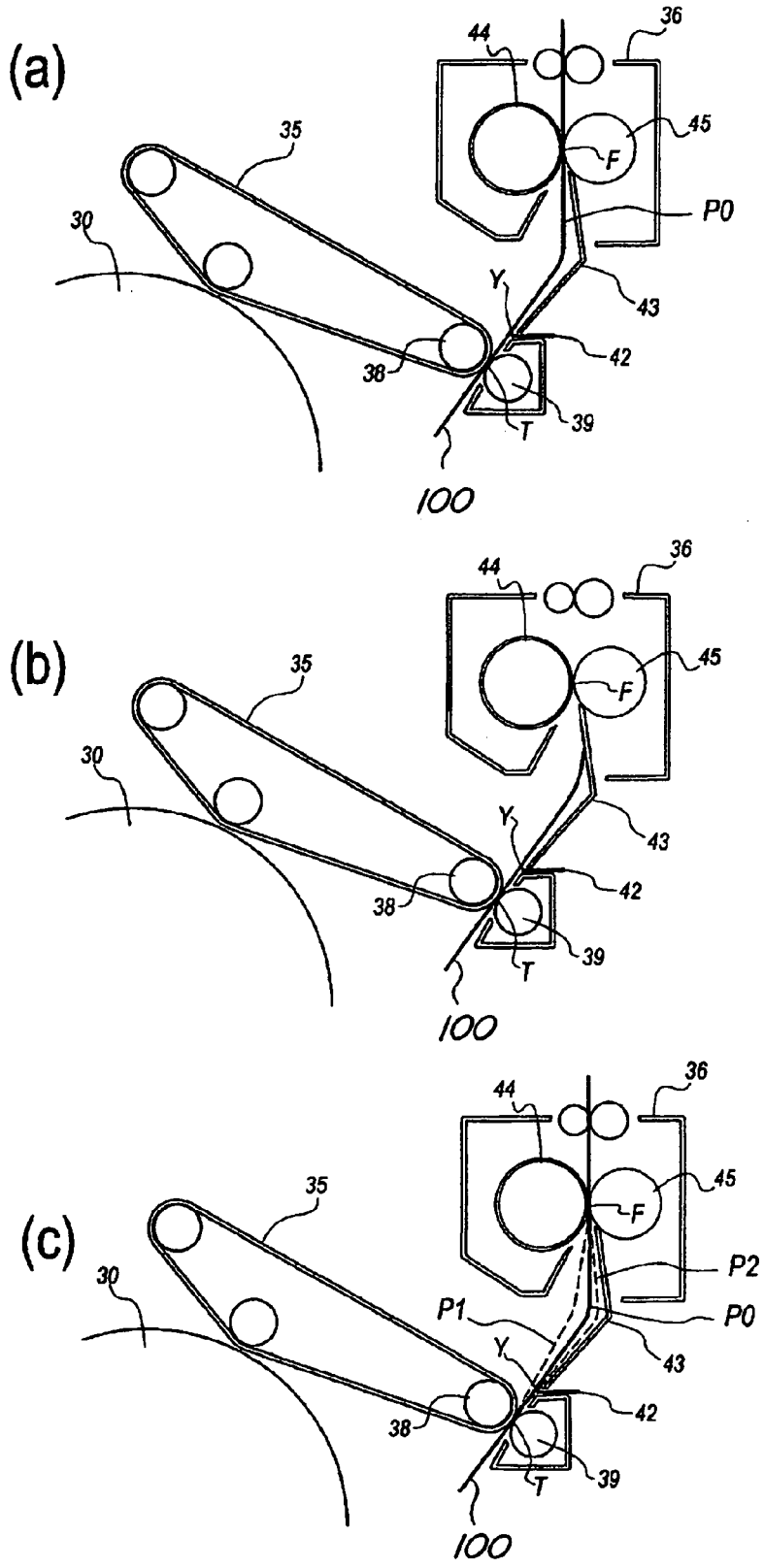
FIG. 8 is a view showing a transfer unit in which an intermediate transfer member is used and a neighborhood of the transfer unit in the image forming apparatus.
Figure 9:
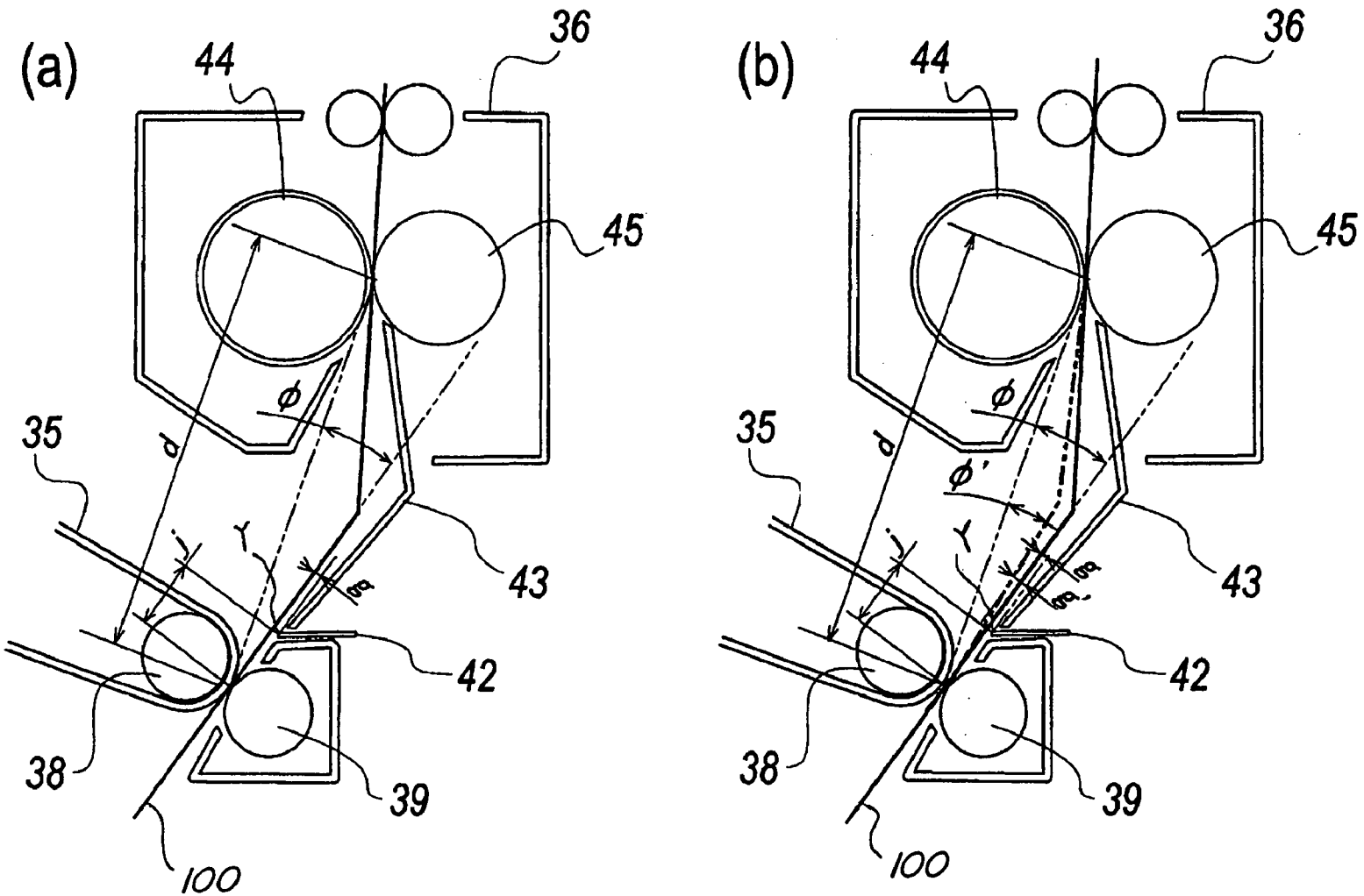
FIG. 9 is a view showing modeling of a loop formed by a sheet.

The gap change amount Δg between the charge removal needle 42 and the sheet 100 will be described by mathematization based on the model of FIG. 8. The model is created by approximating the initial loop amount of sheet during the conveyance to shape of two sides of an isosceles triangle as shown in FIG. 9A. In the isosceles triangle, the two sides include a center T of the transfer nip portion and a center F of the fixing nip portion shown in FIG. 8 respectively. A base of the isosceles triangle is a shortest straight line between the center T of the transfer nip portion and the center F of the fixing nip portion.

The sheet 100 conveyed from the transfer nip portion is first discharged toward a transfer nip portion direction (a tangent direction of the center T of the transfer nip portion and a direction perpendicular to a line connecting the centers of the transfer roller 39 and the transfer opposing roller 38). Accordingly, assuming that an angle (hereinafter referred to as "transfer nip portion angle") formed by the tangent of the center of the transfer nip portion and the shortest straight line between a center T of the transfer nip portion and a center F of the fixing nip portion is ϕ (rad), an isosceles angle becomes ϕ (rad) in the initial loop amount.

On the other hand, when the difference in conveyance speed of the recording material exists between the transfer means and the fixing means, the loop amount is changed to become, e.g., the shape shown by a chain double-dashed line of FIG. 9B. At this point, in FIG. 9B, the isosceles angle is changed ϕ (rad) to ϕ' (rad), and the distance g between the charge removal needle point Y and the sheet 100 is changed to g'.

The change amount Δg of gap between the charge removal needle point Y and the sheet 100, which causes the image defect, is given by the following expression (1):

$$\Delta g=ABS(g'-g) \tag{1}$$

where ABS is a function which determines an absolute value.

The post-change gap amount g' is expressed by the distance j (mm) between the charge removal needle and the center of the transfer nip portion, ϕ, and ϕ' to obtain the following expression (2) (approximation due to a micro angle):

$$g'=g+j\times(\phi-\phi') \tag{2}$$

When the expression (2) is substituted into the expression (1), the expression (3) is obtained:

$$\Delta g=j\times ABS(\phi-\phi') \tag{3}$$

The loop amount change shown in FIG. 9B is generated by a change in loop length between the transfer nip portion and the fixing nip portion, and the change in loop length is caused by the difference in speed between a transfer roller 39 and a fixing roller 44. Assuming that a loop length is L (mm) in an initial loop, the loop length is L' (mm) after the change, and the length of the shortest straight line between the center T of the transfer nip portion and the center F of the fixing nip portion, the following expressions (4) and (5) are geometrically obtained from the isosceles triangle shown in FIG. 9B:

$$\cos\phi = d/L \quad (4)$$

$$\cos\phi' = d/L' \quad (5)$$

On the other hand, L' is given by the following expression (6):

$$L' = L + \Delta L \quad (6)$$

where ΔL (mm) is a change amount of L.

ΔL is expressed by the following expression (7):

$$\Delta L = \Delta V \times T \quad (7)$$

where ΔV (mm/sec) is the difference in conveyance speed between the fixing means and the transfer means and V (sec) is the conveyance time at which the sheet 100 is sandwiched and conveyed by both the transfer nip portion and the fixing nip portion.

At this point, a conveyance time T is given by the following expression (8):

$$T = (P - L)/V \quad (8)$$

where P (mm) is the length of the conveyed sheet, V (mm/sec) is the conveyance speed of the transfer unit, and L (mm) is the initial loop length. The initial loop length L is the sheet length in which the sheet is conveyed only by the transfer unit before the sheet is sandwiched by both the transfer means and the fixing means, and T is the time when the length of the remain part P-L is conveyed at speed V.

When the expression (4) is deformed, the following expression (9) is obtained:

$$L = d/\cos\phi \quad (9)$$

Then, the expression (9) is substituted into the expression (8), the following expression (10) is obtained:

$$T = (P - d/\cos\phi)/V \quad (10)$$

When the expression (10) is substituted into the expression (7), the following expression (11) is obtained:

$$\Delta L = \Delta V \times (P - d/\cos\phi)/V \quad (11)$$

When the expressions (9) and (11) are substituted into the expression (6), the following expression (12) is obtained:

$$L' = d/\cos\phi + (P - d/\cos\phi) \times \Delta V/V \quad (12)$$

When the expression (12) is substituted into the expression (5), the following expression (13) is obtained:

$$\cos\phi' = d/(d/\cos\phi + (P - d/\cos\phi) \times \Delta V/V)) \quad (13)$$

When an inverse function of COS is designated by ACOS, the expression (13) is shown as follows:

$$\phi' = \mathrm{ACOS}(d/(d/\cos\phi + (P - d/\cos\phi) \times \Delta V/V)) \quad (14)$$

When the expression (14) is substituted into the expression (3), the following expression (15) is obtained:

$$\Delta g = j \times ABS(\phi - \mathrm{ACOS}(d/(d/\cos\phi + (P - d/\cos\phi) \times \Delta V/V))) \quad (15)$$

That is, the change amount Δg of gap between the charge removal needle point Y and the sheet is expressed by the length d (mm) of the shortest straight line between the center T of the transfer nip portion and the center F of the fixing nip portion, the angle ϕ (rad) formed by the shortest straight line and the tangent at the center T of the transfer nip portion, the distance j (mm) between the transfer nip portion and the charge removal needle point Y in the transfer nip portion angle direction, the sheet length P (mm), the transfer speed V (mm/sec), and the maximum speed difference ΔV (mm/sec) generated between the transfer nip portion and the fixing nip portion.

At this point, in the recording material on which the image can be formed by the image forming apparatus, the length P (mm) is the length in the sheet (recording material) conveyance direction of the sheet having the longest length in the sheet (recording material) conveyance direction. The length P is determined based on information on specifications of the image forming apparatus such as a service manual and a catalogue.

Therefore, letting 0 (mm)<Δg<=1 (mm) enables the prevention of the image defect caused by the change in distance between the charge removal needle and the sheet.

Then, preferred embodiments of the invention will specifically be described.

First Embodiment

An image forming apparatus according to a first embodiment of the invention will be described. The same component as the above conventional art is designated by the same numeral, and the description of the same component will not be shown.

(Entire Configuration of Image Forming Apparatus)

Figure 7:
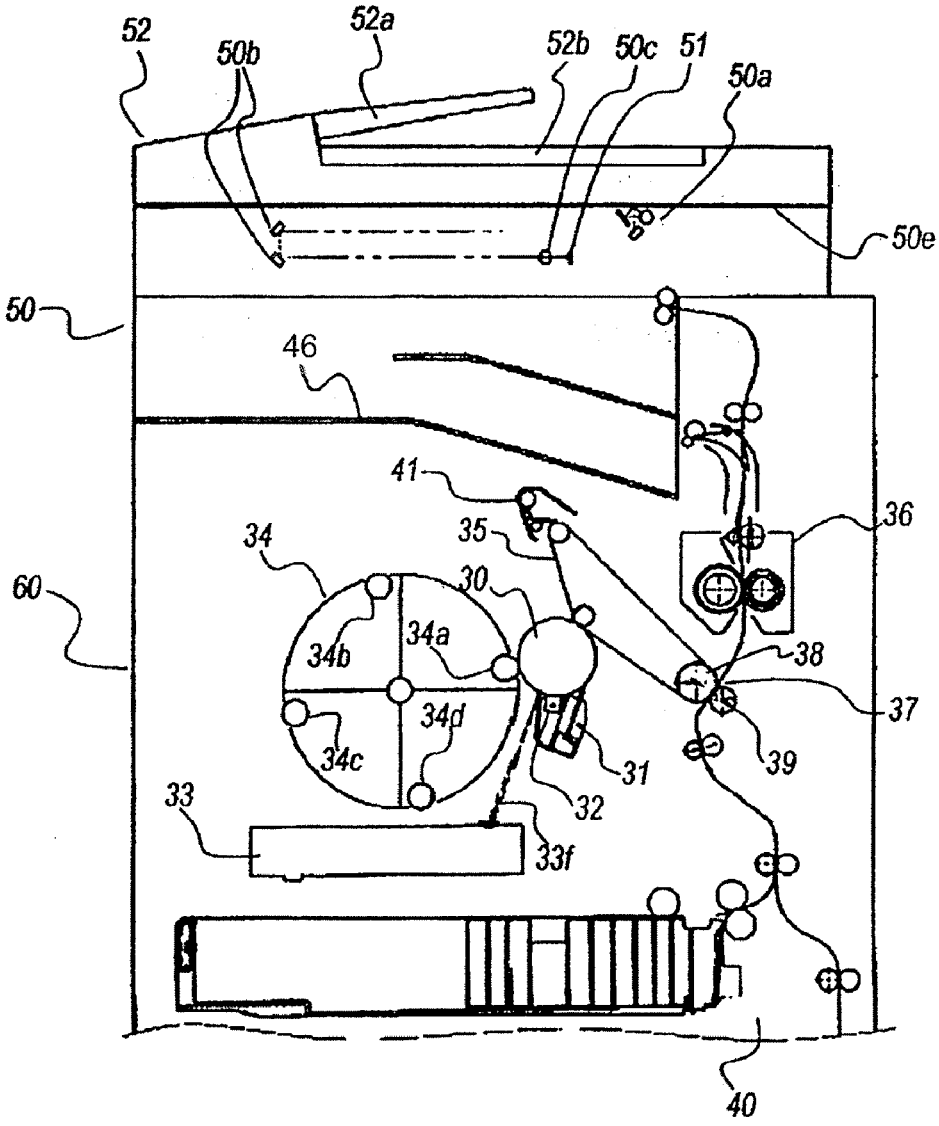
FIG. 7 is a view explaining an entire configuration of an image forming apparatus.

An entire configuration of the image forming apparatus of the first embodiment will be described with reference to FIG. 7. FIG. 7 is a sectional view showing main parts of an original reader unit 50, an original reading device 52, and a printer unit 60 in the color copying machine.

When an operator makes a copy of an original with the color copying machine, the operator first places the original on an original tray 52*a*, and the operator presses a start key (not shown) provided in the original reader unit 50 to operate the color copying machine. Then, in the color copying machine, the original is delivered onto an upper surface of a platen 50*e* by the original reading device 52, and the whole surface of the original is scanned by a first mirror unit 50*a* to read the image. Then the original is discharged to a discharge tray 52*b*. The image scanned by the first mirror unit 50*a* is introduced to CCD 51 through a second mirror unit 50*b* and a lens 50*c*, the image is converted into electronic data, and the electronic data is transmitted to the printer unit 60.

Then, the printer unit 60 performs the transfer to form the color image by superposing the necessary kinds of the color toner among the magenta toner, yellow toner, cyan toner, and black toner on the sheet delivered from a sheet-feeder unit 40 based on the electronic-data color information. A detailed transfer process will be described below in the case where the four full colors are used.

In the printer unit 60, firstly a rotary development body 34 is rotated to cause a magenta development unit 34*a* to oppose a photosensitive drum 30. Then, the photosensitive drum 30 and the intermediate transfer belt 35 are rotated at a constant circumferential speed and at the same circumferential speed. After the surface of the photosensitive drum 30 is evenly charged by charging means 32, the surface receives a laser beam 33*f* from a light scanning device 33 to form an electrostatic latent image for the magenta color. The electrostatic latent image is developed as the magenta toner image by obtaining the magenta toner from the magenta development unit 34*a*, and the developed magenta toner image is transferred to the intermediate transfer belt 35. The magenta toner which is not transferred to the intermediate transfer belt 35 to remain on the photosensitive drum 30 is cleaned by a cleaner 31.

After the magenta development is such completed, the rotary development body 34 is rotated to arrange a cyan development unit 34*b* at a position where the cyan development unit 34*b* opposes the photosensitive drum 30. The cyan toner image is transferred to the intermediate transfer belt 35 in the same manner as the magenta toner image such that the cyan toner image is superposed on the magenta toner image. Then, a yellow development unit 34*c*, and a black development unit 34*d* are sequentially opposed to the photosensitive drum 30, and the toner images are formed on the intermediate transfer belt 35 such that the toner image is superposed on the previous color toner images respectively.

In the intermediate transfer belt 35 on which the four color images of magenta, cyan, yellow, and black are transferred, the toner images are transferred to the sheet delivered from the sheet-feeder unit 40 by the transfer unit 37, and then the remaining toner is scraped by coming into contact with a belt cleaner 41.

Then, the color image is transferred to the sheet which is an example of the recording material, the toner image is fixed onto the sheet by the heating and fixing device 36, and the sheet is discharged on the discharge tray 46 to end the operation.

(Configuration Near Transfer Unit)

Figure 2:
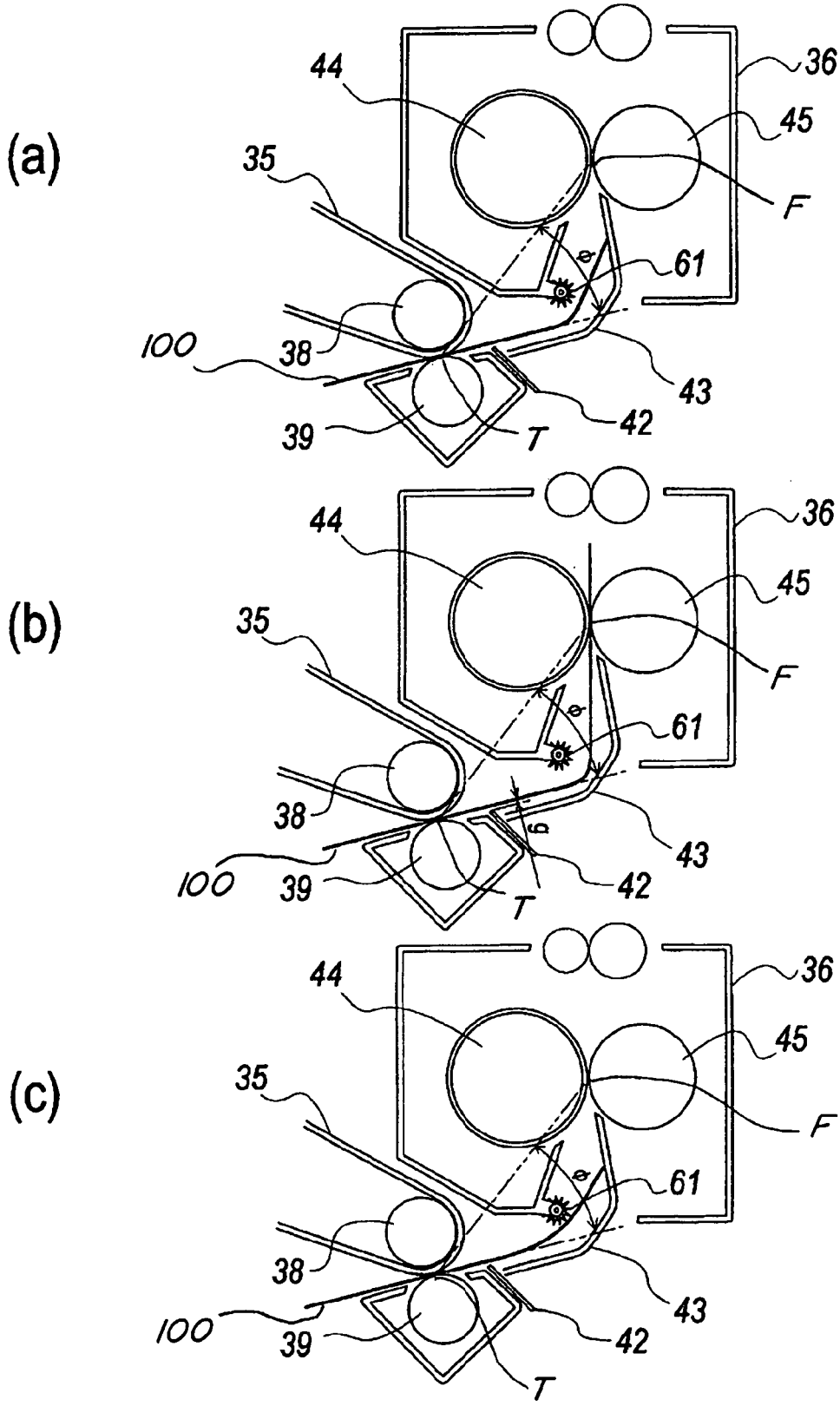
FIG. 2A is a view explaining a state of sheet conveyance.
FIG. 2B is a view explaining a state of sheet conveyance.
FIG. 2C is a view explaining a state of sheet conveyance.
Figure 3:
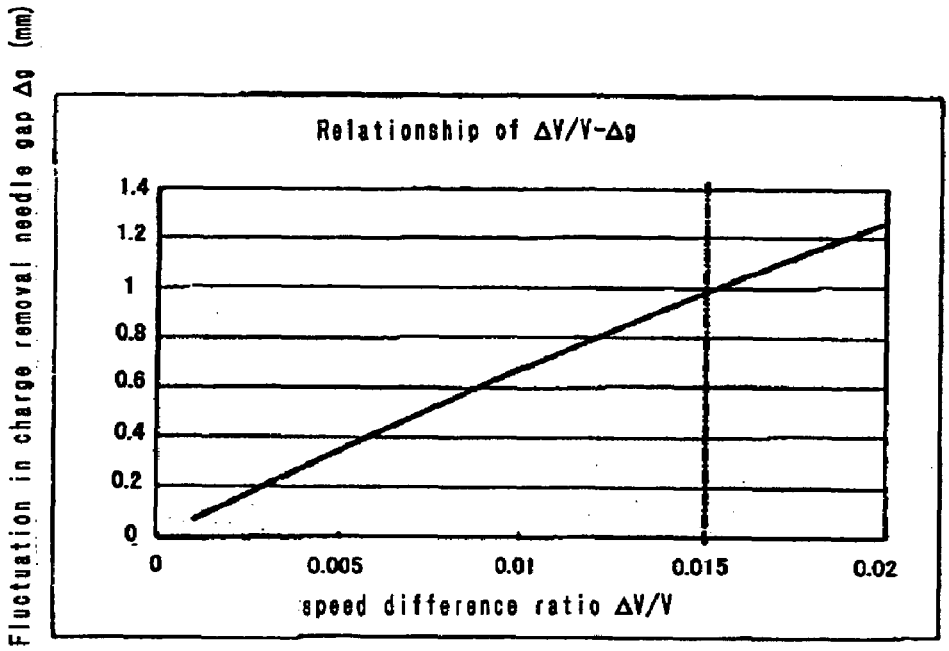
FIG. 3A is a view showing a relationship between a charge removal needle gap $\Delta g$ and a speed fluctuation $\Delta V/V$.
FIG. 3B is a view showing a relationship between the charge removal needle gap Δg and an angle ϕ formed by a shortest straight line and a transfer nip angle.
Figure 3:
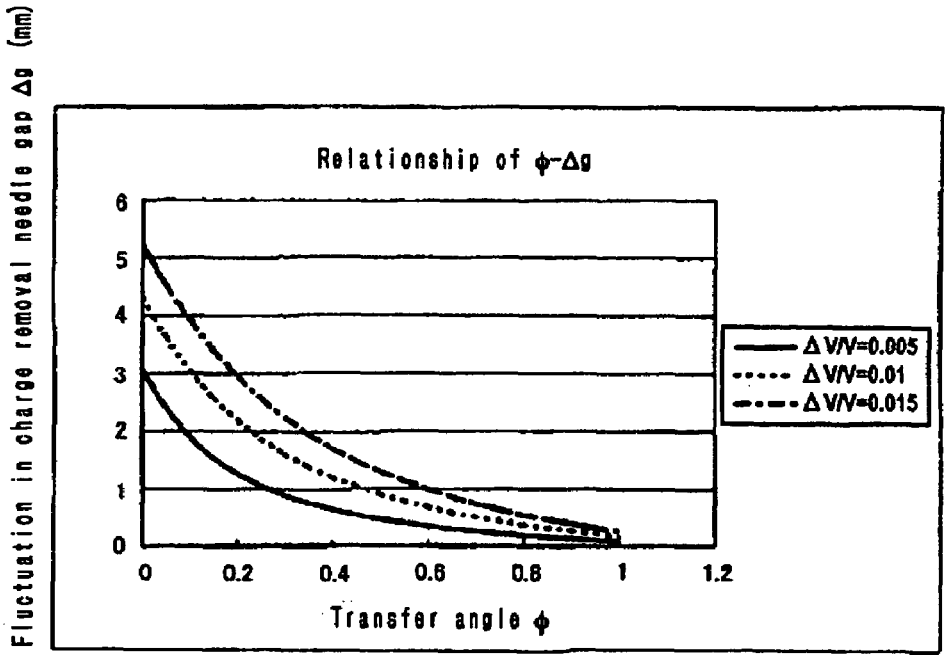

FIG. 1 is a view explaining the transfer unit and its neighborhood in the image forming apparatus according to the first embodiment, and FIG. 2 is a view explaining a state of the sheet conveyance. FIG. 3A is a view showing a relationship between the charge removal needle gap Δg and the speed fluctuation ΔV/V, and FIG. 3B is a view showing a relationship between the charge removal needle gap Δg and the angle ϕ formed by the shortest straight line and the transfer nip angle. The toner images on the photosensitive drum 30 are primary-transferred in the superposing manner to the intermediate transfer belt (image bearing member) 35 which is an example of the intermediate transfer member. The color toner image on the intermediate transfer belt 35 is collectively secondary-transferred to the sheet by the transfer roller 39 which is an example of the transfer means. The transfer roller 39 abuts on the intermediate transfer belt 35 with relatively large abutting pressure (20 (N) in the first embodiment) to form the transfer nip portion. The predetermined bias voltage is applied between the transfer roller 39 and the transfer opposing roller 38, which is an example of rollers straining the intermediate transfer belt 35, by power supply means 391. The speed of the sheet which is sandwiched and conveyed by the intermediate transfer belt 35 and the transfer roller 39 is 150 mm/sec in the transfer nip portion.

The sheet to which the toner image is transferred is conveyed to the heating and fixing device 36 which is an example of the fixing device. In the heating and fixing device 36, the pressure roller 45 abuts on the fixing roller 44 with a predetermined abutting pressure to form the fixing nip portion. The fixing roller 44 has heating means therein. The pressure roller 44 is driven by rotating the pressure roller 45, and the toner image is fixed onto the sheet by the heat and pressure. The guide member 43 and the charge removal needle (electrode member) 42 are arranged between the transfer nip portion and the fixing nip portion. The guide member 43 guides the sheet to the fixing nip portion, and the charge removal needle 42 is an example of the charge removal means for removing the charge on the charged sheet. In the recording material conveyance direction, the charge removal needle 42 is provided on the upstream side of the transfer means and on the downstream side of the fixing means.

A spur 61 which is an example of buckling means is arranged on the side (inside corner of bending portion) opposite a bending portion of the guide member 43. The spur is a driven roller having plural projection whose leading end is sharpened, and the spur 61 can abut on the recording surface without disturbing the transferred toner image.

As shown in FIG. 2A, the sheet 100 conveyed by the transfer nip portion is introduced to the fixing nip portion while the front end of the sheet is guided by the guide member 43. At this point, the usual sheet 100 having low rigidity is buckled by the guide member 43, and the front end of the sheet 100 reaches the fixing nip portion while the sheet 100 forms the loop as shown in FIG. 2B. On the other hand, as shown in FIG. 2C, in the case of the sheet 100 having the high rigidity such as a cardboard, the front end of the sheet 100 is guided by the guide member 43 while the sheet 100 is not buckled. When the surface of the sheet 100 comes into contact with the spur 61, the sheet 100 is forcedly buckled by the spur. At the time when the front end of the sheet 100 reaches the fixing nip portion, as shown in FIG. 2B, the sheet 100 is bent to form the loop irrespective of the rigidity of the sheet 100. That is, the spur 61 comes into contact with the sheet 100 to guide the conveyance direction of the sheet 100 before the sheet 100 reaches the fixing nip portion.

After the sheet 100 is sandwiched by the fixing nip portion, the loop amount shown in FIG. 2B is kept, and the transfer process, the charge removal process, and the fixing process are performed while the sheet 100 is simultaneously sandwiched and conveyed by the transfer nip portion and the fixing nip portion. The conveyance speed of the sheet 100 is 151 mm/sec in the fixing nip portion. The sheet 100 is not in contact with the spur 61 while the sheet 100 is simultaneously sandwiched and conveyed by the transfer nip portion and fixing nip portion.

Further, while the sheet 100 is simultaneously sandwiched and conveyed by the transfer nip portion and fixing nip portion, the sheet 100 is conveyed with no contact with any members between the transfer nip portion and the fixing nip portion.

At this point, the loop amount shown in FIG. 2B is changed by the difference between the conveyance speed of the transfer nip portion and the conveyance speed of the fixing nip portion, which changes the gap g between the charge removal needle point Y and the sheet.

The change in gap Δg is expressed as follows by the above expression (15):

$$\Delta g = j \times ABS(\phi - \mathrm{ACOS}(d/(d/\mathrm{COS}\ \phi + (P - d/\mathrm{COS}\ \phi) \times \Delta V/V)))$$

For the specific numerical values of the positional relationship among the members in the first embodiment, the length d of the shortest straight line between the center T of the transfer nip portion and the center F of the fixing nip portion is 70 mm, the angle ϕ (transfer nip portion angle) formed by the shortest straight line and the tangent at the center T of the transfer nip portion is 0.663 rad (38°), and the distance j between the center T of the transfer nip portion and the charge removal needle 42 and the center T of the transfer nip portion in the tangent direction is 15 mm (see FIG. 1). In the first embodiment, the maximum length P of the conveyed sheet is set at 420 mm. When the numerical values are substituted into the expression (15), the relationship between Δg and ΔV/V becomes as shown in FIG. 3A.

In the heating and fixing device 36 of the first embodiment, due to the drive of the pressure roller 45, a change in diameter of the pressure roller 45 is generated by a change in temperature of the pressure roller 45, which causes a fluctuation in speed within ±0.5%. The speed fluctuations caused by a tolerance of the roller diameter from machining are generated in both the transfer roller 39 and the fixing roller 44, the fluctuation in speed difference between the transfer nip portion and the fixing nip portion is generated within ±0.3%, and the fluctuation in motor drive accuracy is generated within ±0.2%. Further, the fluctuation in speed caused by fixing slip depending on density of the unfixed image on the sheet is generated within ±0.5%. The summation of the speed fluctuations becomes ±1.5% between the transfer nip portion and the fixing nip portion in the first embodiment. However, as can be seen from FIG. 3A, even in the maximum speed difference $\Delta V/V=0.015$ (1.5%), the fluctuation in gap $\Delta g$ of the charge removal needle is suppressed not more than 1 mm which is an example of a limit in which the image defect is generated.

Therefore, in the image forming apparatus according to the first embodiment, the fluctuation in charge removal needle gap can be suppressed by the geometrical arrangement of the members in the short path between the transfer nip portion and the fixing nip portion, and the image forming apparatus in which no image defect is generated can be provided.

As described above, the fluctuation in gap $\Delta g$ of charge removal needle is shown by the expression (15).

For example, d=80 (mm), j=15 (mm), P=420 (mm), and the three speed differences ($\Delta V/V=0.005$, $\Delta V/V=0.01$, and $\Delta V/V=0.015$) are substituted into the expression (15), and the relationship between the angle $\phi$ of the transfer nip portion and the charge removal needle gap $\Delta g$ is determined. FIG. 3B shows the charge removal needle gap $\Delta g$ shown as a variable of the angle $\phi$ of the transfer nip portion. As can be seen from FIG. 3B, when the angle $\phi$ of the transfer nip portion is increased (i.e., bending amount of the conveyance path is increased), the fluctuation in gap $\Delta g$ of the charge removal needle can largely be decreased.

In order that the $\Delta V/V$ is smaller than 0.005 (0.5%), it is generally necessary that high-accuracy motor is used for the drive and the dimensions of the roller diameters are machined with high accuracy. However, according to the invention, the angle $\phi$ is set such that the gap fluctuation amount of charge removal needle can be suppressed within 1 mm even in the case of $\Delta V/V>=0.005$. Therefore, the fluctuation in gap $\Delta g$ of the charge removal needle 42 can be suppressed by the geometrical arrangement of the members without using the special machining and configuration.

Further, when the film-like heating member is driven by a sponge roller in the energy-saving fixing device, generally the fluctuation in speed is generated within ±1.5% due to the fluctuation in sponge, and the speed fluctuation is generated by about ±3.0% at the maximum when the component accuracy and the fixing slip are added. Therefore, speed control of the fixing or loop control is required. However, according to the invention, the angle $\phi$ is set such that the gap fluctuation amount of charge removal needle can be suppressed within 1 mm even in the case of $0.3>=\Delta V/V>0.015$. Therefore, the gap fluctuation $\Delta g$ of the charge removal needle 42 can be suppressed by the geometrical arrangement of the members without using the special machining and configuration.

Thus, even if the straight line distance d between the centers of the transfer nip portion and the fixing nip portion in the recording-material conveyance direction is 0 (mm)<d<=80 (mm) in order to miniaturize the image forming apparatus, the image defect can be prevented because of 0 (mm)<$\Delta g$ <=1 (mm).

Second Embodiment

An image forming apparatus according to a second embodiment of the invention will be described. The same component as the first embodiment is designated by the same numeral, and the description of the same component will not be shown.

In the second embodiment, in order to form the gap fluctuation of 0 (mm)<$\Delta g$<=1 (mm), control for keeping the loop amount is performed. In the control, the loop shape of the sheet is detected, and the loop amount is kept by feedback of the detection result to the sheet conveyance speed of the transfer nip portion or the sheet conveyance speed of the fixing nip portion. In this case, because the speed is frequently changed in the fixing roller and the transfer roller in order to keep the gap $\Delta g$ to a sufficiently small level, a noise becomes troublesome. In the second embodiment, a cycle of the speed switch is made more appropriate to suppress the noise while the image defect caused by the change in distance between the charge removal needle and the sheet is suppressed.

Figure 10:
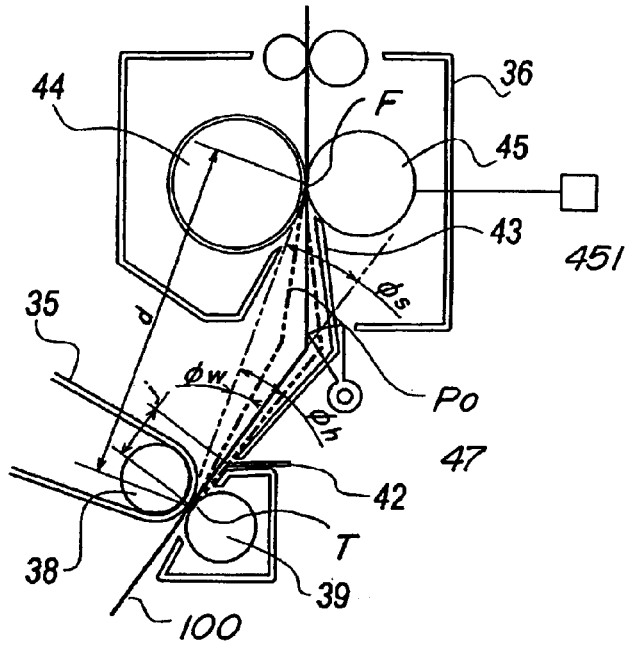
FIG. 10 is a view showing a transfer unit provided with loop detection control and its neighborhood.
Figure 10:
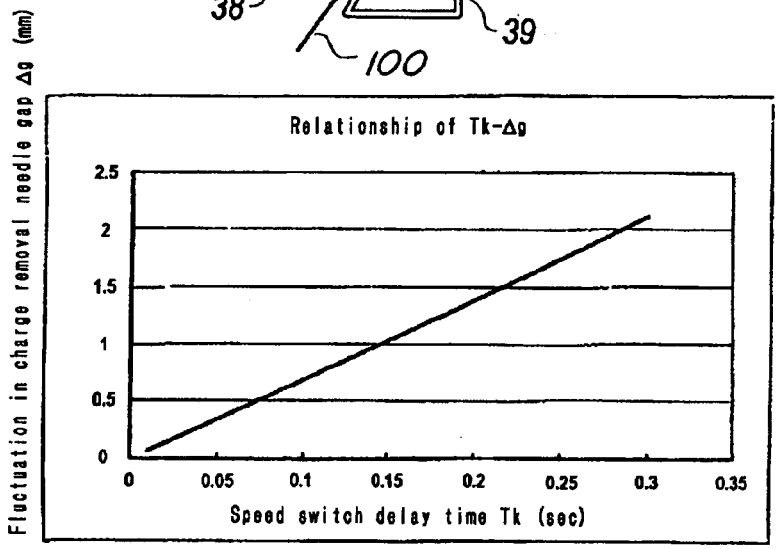
Figure 10:
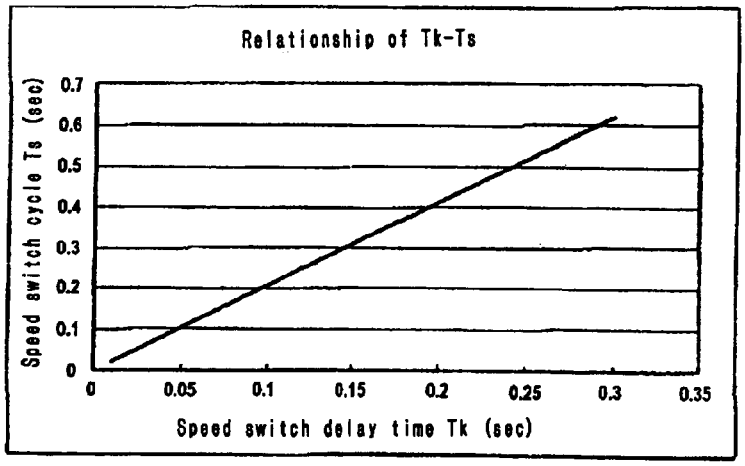

FIG. 10 is a view explaining a transfer unit provided with loop detection control and its neighborhood. As shown in FIG. 10A, a loop detection sensor 47 which is an example of detection means for detecting the loop amount generated in the sheet is provided between the transfer nip portion and the fixing nip portion. When the loop becomes larger than the initial loop P0, the loop detection sensor (detection means) 47 is rotated to turn on a photosensor (not shown). A speed variable motor 451 is used as the drive means for the pressure roller 45, and the speed variable motor 451 can be switched between Vh (mm/sec) faster than the transfer conveyance speed V (mm/sec) and Vw (mm/sec) slower than the transfer conveyance speed V (mm/sec).

In conveying the sheet 100, the control is performed as follows. That is, the fixing speed is set at Vw when the loop becomes large to turn on the loop detection sensor 47, and the fixing speed is set at Vh the loop detection sensor 47 is turned off. At this point, a switch delay time Tk (sec) between on/off of the sensor and the actual speed switch is generated due to mechanism control or intention. As shown by a broken line of FIG. 10A, the loop amount of the sheet is pulsated around the loop amount detected by the loop detection sensor 47. In this case, when the charge removal needle gap $\Delta g$ is determined like the example shown in FIG. 9B, the following expression (16) is obtained.

$$\Delta g=j\times(\phi h-\phi w) \tag{16}$$

Where $\phi h$ is an angle formed by the sheet 100 and the shortest straight line connecting the center T of the transfer nip portion and the center F of the fixing nip portion in the upper-limit loop amount in a moment at which the fixing speed is switched Vw to Vh, and $\phi w$ is an angle formed by the sheet 100 and the shortest straight line connecting the center T of the transfer nip portion and the center F of the fixing nip portion in the lower-limit loop amount in a moment at which the fixing speed is switched Vh to Vw. The center T of the transfer nip portion and the center F of the fixing nip portion shall mean the center in the conveyance direction of the sheet 100.

When the loop length is set at Lh (mm) in the upper-limit loop, the following expression (17) is geometrically obtained:

$$\cos \phi h = d/Lh \quad (17)$$

On the other hand, when the loop length is set at Ls (mm) in the loop amount when the loop detection sensor is turned on and off, the following expression (18) is given:

$$Lh = Ls + (Vh - V) \times Tk \quad (18)$$

Assuming that an angle formed by the shortest straight line and the sheet portion going through the transfer nip portion is set at a loop sensor detection angle ϕs (rad) when the loop detection sensor 47 detects the loop amount, the following expression (19) is obtained:

$$\cos \phi s = d/Ls \quad (19)$$

Therefore, the following expression (20) is substituted in to the expression (18), $$Ls = d/\cos \phi s \quad (20)$$

the following expression (21) is obtained:

$$Lh = d/\cos \phi s + (Vh - V) \times Tk \quad (21)$$

When the expression (21) is substituted into the expression (17), the following expression (22) is obtained:

$$\cos \phi h = d/(d/\cos \phi s + (Vh - V) \times Tk) \quad (22)$$

Therefore, the following expression (23) is obtained:

$$\phi h = \mathrm{ACOS}(d/(d/\cos \phi s + (Vh - V) \times Tk)) \quad (23)$$

When the angle ϕw on the lower-limit loop side is determined in the similar way, the following expression (24) is obtained:

$$\phi w = \mathrm{ACOS}(d/(d/\cos \phi s + (Vw - V) \times Tk)) \quad (24)$$

When the expressions (23) and (24) are substituted into the expression (16), the following expression (25) is obtained:

$$\Delta g = j \times (\mathrm{ACOS}(d/(d/\cos \phi s + (Vh - V) \times Tk)) - \mathrm{ACOS}(d/(d/\cos \phi + (Vw - V) \times Tk))) \quad (25)$$

On the other hand, when the speed switch cycle time in which the loop is pulsated is set at Ts (sec), Ts becomes the summation of the following times. That is, Ts includes the delay time Tk when the speed is switched Vw to Vh since the sensor is turned on, the time when the loop grown by the delay is eliminated by the speed Vh to turn off the sensor, the delay time Tk when the speed is switched Vh to Vw since the sensor is turned off, and the time when the loop decreased by the delay is eliminated by the speed Vw to turn on the sensor. When the Ts is shown by the following expression (26):

$$Ts = Tk + (V - Vw) \times Tk/Vh + Tk + (Vh - V) \times Tk/Vw \quad (26)$$

For example, in the transfer unit provided with loop detection control shown in FIG. 10A, when d=80 (mm), ϕs=0.26 (rad) (15°), j=15 (mm), V=150 (mm/sec), Vh=155 (mm/sec), and Vw=145 (mm/sec) are substituted into the expressions (25) and (26), the relationship between the switch delay time Tk (sec) and the fluctuation in charge removal needle gap Δg (mm) and the relationship between the switch delay time Tk (sec) and the speed switch cycle time Ts (sec) are determined as shown in FIGS. 10B and 10C.

As can be seen from FIG. 10B, the gap Δg (mm) can be decreased when the switch delay time Tk is decreased. However, in this case, the speed switch cycle is decreased as can be seen from FIG. 10C. In the short speed-switch-cycle, the drive speed is not stable because the drive speed is always changed. Therefore, the problem that noise is increased from the motor and the drive mechanism is generated. Particularly, in the case of Ts<=0.5 (sec), the noise becomes remarkable.

Figure 4:
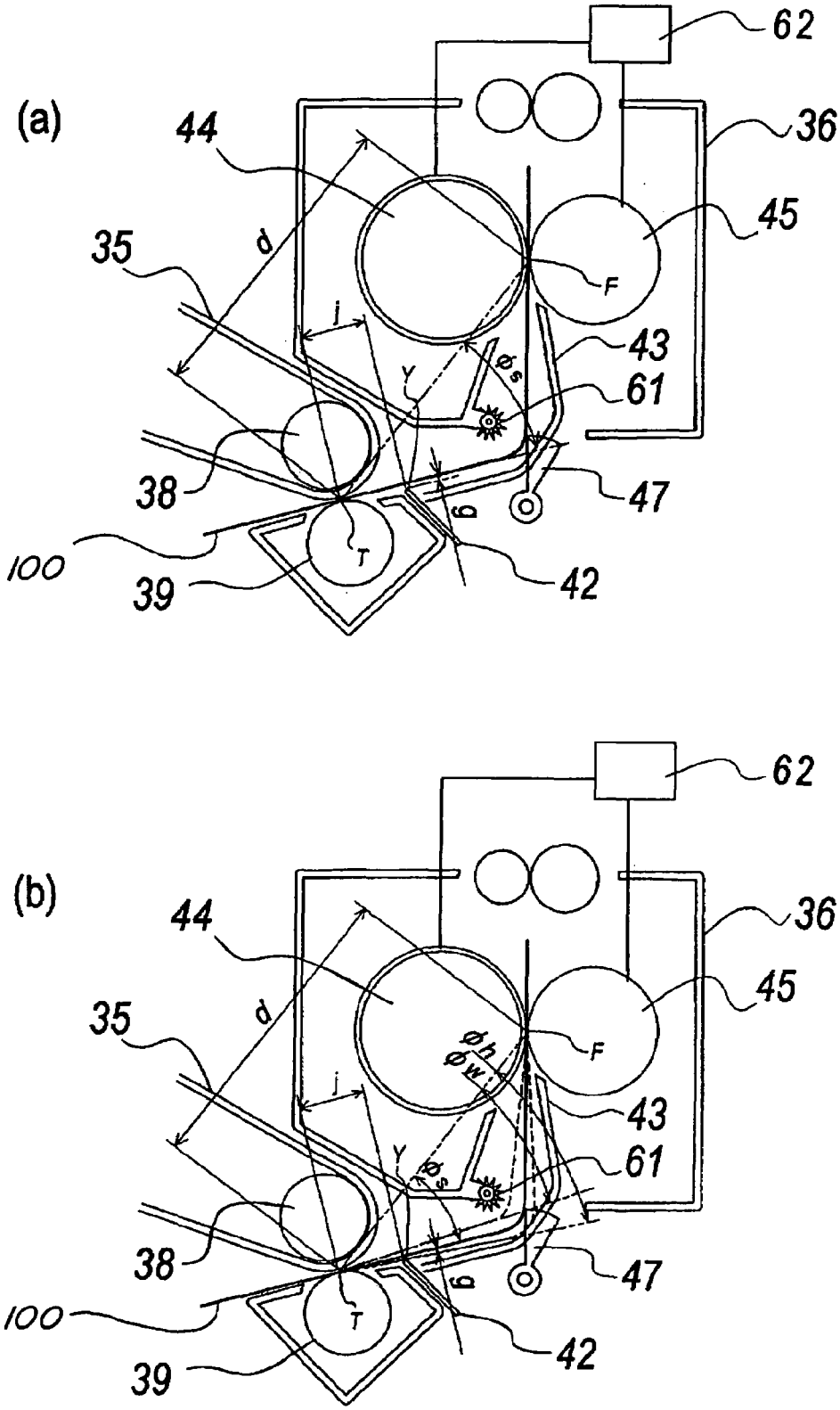
FIG. 4 is a view explaining a transfer unit and its neighborhood in an image forming apparatus according to a second embodiment.
Figure 5:
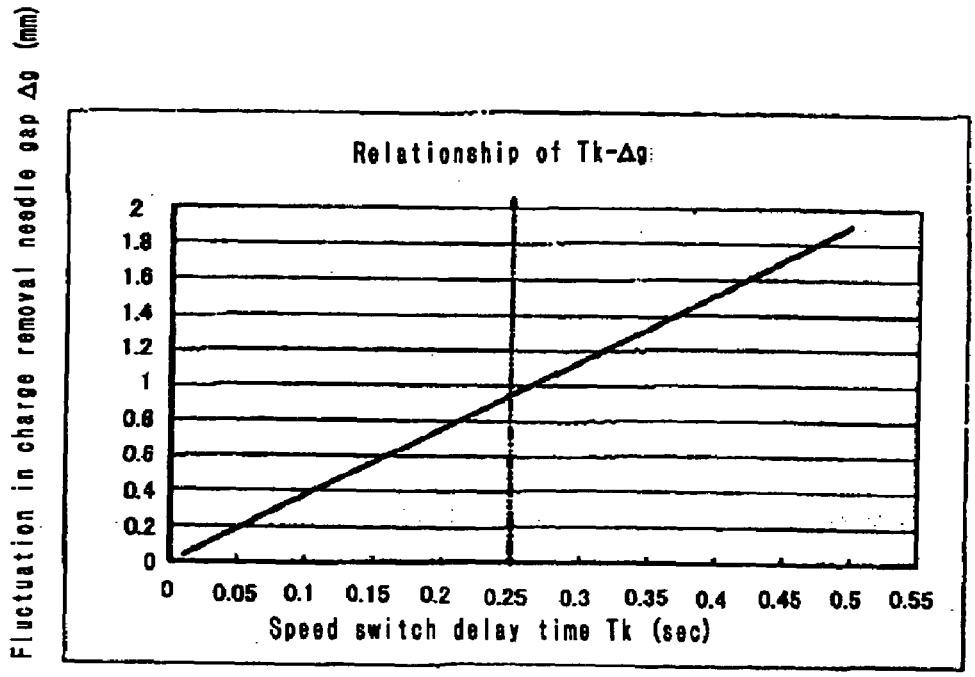
FIG. 5A is a view showing a relationship between the charge removal needle gap Δg and a speed switch delay time Tk.
FIG. 5B is a view showing a relationship between a speed switch cycle Ts and the speed switch delay time Tk.
Figure 5:
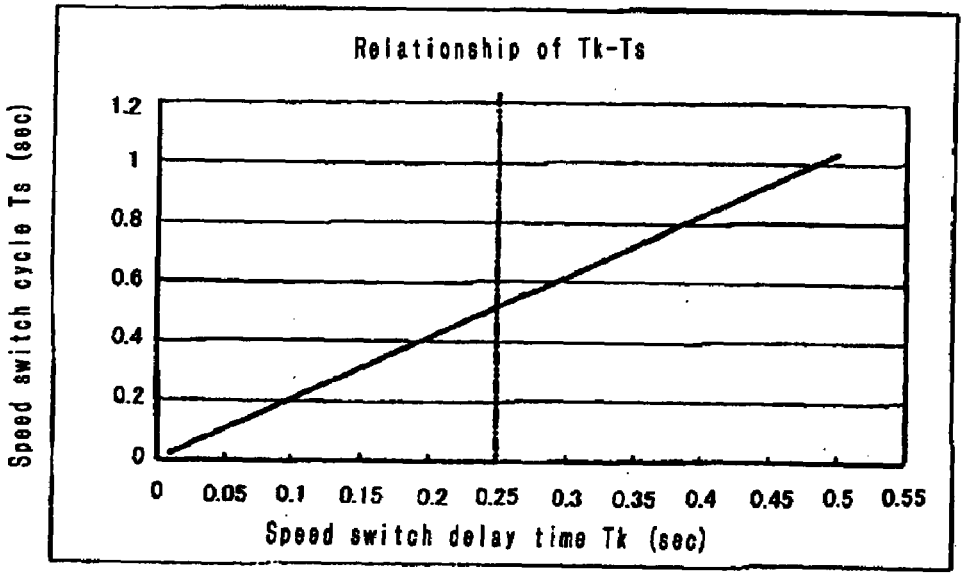
Figure 6:
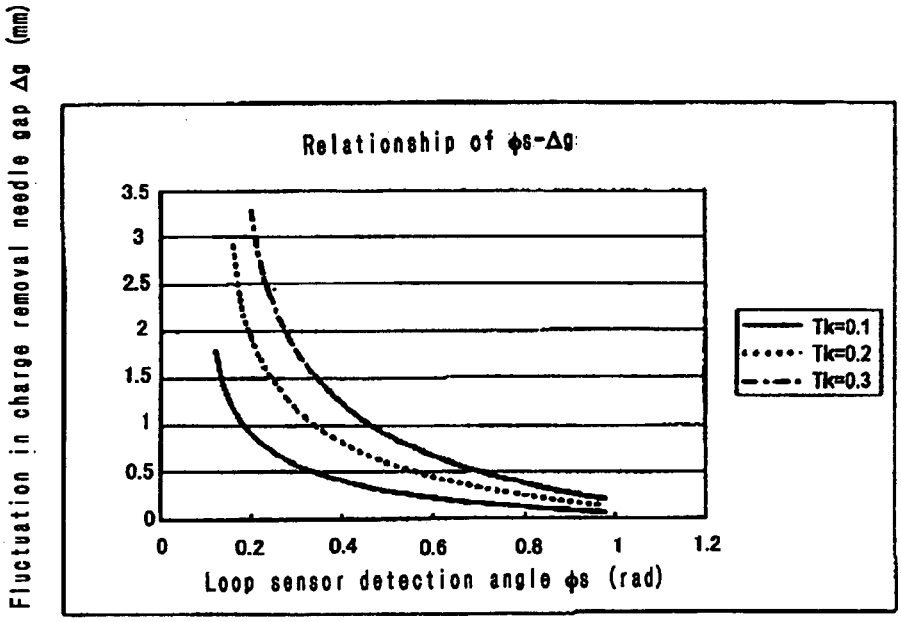
FIG. 6 is a view showing a relationship between the charge removal needle gap Δg and a loop sensor detection angle ϕs.

FIG. 4 is a view showing the transfer unit according to the second embodiment and its neighborhood. FIG. 5A is a view showing the relationship between the charge removal needle gap Δg and the speed switch delay time Tk, and FIG. 5B is a view showing the relationship between the speed switch cycle Ts and the speed switch delay time Tk. FIG. 6 is a view showing the relationship between the charge removal needle gap Δg and the loop sensor detection angle ϕs. As shown in FIG. 4A, in the second embodiment, the loop detection sensor 47 which is an example of the detection means for detecting the loop amount of the state generated in the sheet 100 is provided between the transfer nip portion and the fixing nip portion. When the loop becomes larger than the initial loop P0, the loop detection sensor 47 is rotated to turn on a photosensor (not shown). The speed variable motor (not shown) is used as the drive means for the pair of pressure rollers 44 and 45, and switch means 62 can switch the speed variable motor between Vh (mm/sec) faster than the transfer conveyance speed V (mm/sec) and Vw (mm/sec) slower than the transfer conveyance speed V (mm/sec).

For the specific numerical values of the positional relationship among the members in the second embodiment, the length d of the shortest straight line between the center T of the transfer nip portion and the center F of the fixing nip portion is 60 mm, the loop sensor detection angle ϕs formed by the shortest straight line and the sheet going through the transfer nip portion is 0.524 rad (30°) when the loop detection sensor 47 detects the loop amount, and the distance j between the center T of the transfer nip portion and the charge removal needle 42 and the center T of the transfer nip portion in the tangent direction is 15 mm. At this point, the loop amount is expressed by the angle formed by the shortest straight line and the sheet gone through the transfer nip portion. That is, the loop amount is increased when the angle formed by the shortest straight line and the sheet gone through the transfer nip portion is increased.

In the second embodiment, the conveyance speed V of the transfer roller 39 is set at 150 mm/sec. The conveyance speed of the fixing roller 44 is set so as to be switched faster to Vh=155 (mm/sec) after the predetermined delay time Tk (sec) by a trigger in which the loop detection sensor 47 is switched the turn-off to the turn-on. Further, the conveyance speed of the fixing roller 44 is set so as to be switched slower to Vw=145 (mm/sec) after the predetermined delay time Tk (sec) by the trigger in which the loop detection sensor 47 is switched the turn-on to the turn-off.

As shown by the broken line in FIG. 4B, the loop amount of the sheet after the sheet is sandwiched by the fixing nip portion is pulsated around the loop amount at the time when the loop detection sensor 47 detects the loop amount. In FIG. 4B, ϕh is the angle formed by the sheet and the shortest straight line connecting the center T of the transfer nip portion and the center F of the fixing nip portion in the upper-limit loop amount in the moment at which the fixing speed is switched Vw to Vh, and ϕw is the angle formed by the sheet and the shortest straight line connecting the center T of the transfer nip portion and the center F of the fixing nip portion in the lower-limit loop amount in the moment at which the fixing speed is switched Vh to Vw. In the second embodiment, $\phi w$ is 25°, and $\phi h$ is 32°.

At this point, the fluctuation in gap $\Delta g$ between the sheet and the point of the charge removal needle 42 is shown by the expression (16):

$$\Delta g = j \times (\phi h - \phi w) \tag{16}$$

As described in the first embodiment, the expression (25) is given:

$$\Delta g = j \times (\mathrm{ACOS}(d/(d/\mathrm{COS}\ \phi s + (Vh - V) \times Tk)) - \mathrm{ACOS}(d/(d/\mathrm{COS}\ \phi + (Vw - V) \times Tk))) \tag{25}$$

When the numerical values in the second embodiment are substituted into the expression (25), the relationship between the gap $\Delta g$ and the delay time Tk is obtained as shown in FIG. 5A. When the relationship shown in FIG. 5A is compared with the relationship shown in FIG. 10B, it is found that the fluctuation in gap $\Delta g$ is substantially decreased to the delay time Tk.

The cycle time Ts of the speed switch in which the loop is pulsated is shown by the above expression (26).

$$Ts = Tk + (V - Vw) \times Tk/Vh + Tk + (Vh - V) \times Tk/Vw \tag{26}$$

When the relationship between the speed switch cycle time Ts and the delay time Tk is determined by the expression (26), the result is obtained as shown in FIG. 5B. When the relationship shown in FIG. 5B is compared with the relationship shown in FIG. 10C, it is found that the same relationship is substantially obtained.

The delay time Tk when the fixing speed is switched since the sensor detects the loop amount is set at 0.25 (sec) in the second embodiment. In this case, $\Delta g$=0.94 (mm) is obtained from FIG. 5A, and Ts=0.52 (sec) is obtained from FIG. 5B. That is, while the sufficient stable time is secured after the speed of the drive motor is switched, the fluctuation in gap between the sheet and the charge removal needle can be suppressed within 1 mm in which the image defect is not generated.

Thus, in the image forming apparatus according to the second embodiment, the loop detection control is also used in the short path between the transfer nip portion and the fixing nip portion, and the loop detection sensor is arranged such that the loop amount is sufficiently bent in detecting the loop. Therefore, the fluctuation in charge removal needle gap can be suppressed in the speed switch cycle in which the problem such as the noise does not exist, and the small-size and cheap image forming apparatus in which the image defect is not generated can be realized.

The fluctuation in charge removal needle gap $\Delta g$ is shown by the expression (25) in the modeling of the image forming apparatus equipped with the loop detection control. For example, d=80 (mm), j=15 (mm), V=150 (mm/sec), Vh=155 (mm/sec), Vw=145 (mm/sec), and the three switch delay time Tk (sec) (Tk=0.1, Tk=0.2, and Tk=0.3) are substituted into the expression (25), and the relationship between the loop sensor detection angle $\phi s$ and the fluctuation in gap $\Delta g$ of the charge removal needle is determined. FIG. 6 shows the charge removal needle gap $\Delta g$ shown as a variable of the loop sensor detection angle $\phi s$. As can be seen from FIG. 6, when the loop sensor detection angle $\phi s$ is increased (i.e., bending amount of the conveyance path is increased), the fluctuation in gap $\Delta g$ of the charge removal needle can largely be decreased.

That is, even if the path between the transfer nip portion and the fixing nip portion is shortened, the fluctuation in gap $\Delta g$ of the charge removal needle 42 can be suppressed not more than 1 (mm) by increasing the loop sensor detection angle $\phi s$ without need of switching the speed of the cycle minutely. Therefore, the image forming apparatus can be miniaturized without generating the noise problem and the image defect. Further, since the speed switch cycle Ts is set at least 0.5 (sec), a DC motor and the like in which a relatively long time is required for a speed stabilizing time in switching the speed can also sufficiently be used as the drive means for the heating and fixing device 36.

CROSS-REFERENCE TO RELATED APPLICATION

This application claims the benefit of priority from the prior Japanese Patent Application No. 2004-353841 filed on Dec. 7, 2004 the entire contents of which are incorporated by reference herein.

What is claimed is:

1. An image forming apparatus comprising:

an image bearing member which bears a toner image;

transfer means which is in contact with said image bearing member to form a transfer nip portion, which sandwiches and conveys recording material with said image bearing member in said transfer nip portion, and which transfers said toner image to said recording material;

fixing means in which said recording material is sandwiched in a fixing nip portion where a first fixing member and a second fixing member are in contact with each other, the fixing means which fixes said toner image to said recording material; and an electrode member which is provided between said transfer means and said fixing means, wherein said recording material is sandwiched and conveyed by said fixing means while sandwiched and conveyed by said transfer means, a length d (mm) of a shortest straight line connecting a center of said transfer nip portion and a center of said fixing nip portion in a direction in which said recording material is conveyed satisfies 0 (mm)<d<=80 (mm), and wherein assuming that an angle formed by said shortest straight line and a tangent being in contact with said transfer means in the center of said transfer nip portion is $\phi$ (rad), a distance between the center of said transfer nip portion and a position nearest to said recording material of said electrode member is j (mm) in the direction parallel to said tangent being in contact with said transfer means, a maximum length of said recording material is P (mm) in the direction in which the recording material is conveyed, a speed at which said recording material is conveyed by said transfer means is V (mm/sec), and a maximum speed difference generated between said speed V (mm/sec) and a speed at which said recording material is conveyed by said fixing means is $\Delta V$ (mm/sec), said angle $\phi$ satisfies $0 < j \times \mathrm{ABS}(\phi - \mathrm{ACOS}(d/(d/\mathrm{COS}\ \phi + (P - d/\mathrm{COS}\ \phi) \times \Delta V/V))) <= 1$ (mm), where ABS is a function which determines an absolute value and ACOS is an inverse function of COS.

2. An image forming apparatus according to claim 1, wherein said maximum speed difference $\Delta V$ (mm/sec) satisfies $0.015 >= \Delta V/V >= 0.005$.

3. An image forming apparatus according to claim 1, wherein said maximum speed difference $\Delta V$ (mm/sec) satisfies $0.03 >= \Delta V/V > 0.015$.

4. An image forming apparatus comprising:

an image bearing member which bears a toner image;

transfer means which forms a transfer nip portion while being in contact with said image bearing member, which sandwiches and conveys a recording material with said image bearing member in said transfer nip portion, and which transfers said toner image to said recording material;

fixing means in which said recording material is sandwiched in a fixing nip portion where a first fixing member and a second fixing member are in contact with each other, the fixing means which fixes said toner image to said recording material;

an electrode member which is provided between said transfer means and said fixing means;

detection means for detecting a state of a loop generated in said recording material between said transfer means and said fixing means; and switch means which switches a speed at which said recording material is sandwiched and conveyed by said fixing means to a first speed Vh (mm/sec) or a second speed Vw (mm/sec) based on the detection result of said detection means, the first speed Vh (mm/sec) being faster than a speed V (mm/sec) at which said recording material is sandwiched and conveyed by said transfer means, the second speed Vw (mm/sec) being slower than said speed V, wherein said recording material is sandwiched and conveyed by said fixing means while sandwiched and conveyed by said transfer means, a length d (mm) of a shortest straight line connecting a center of said transfer nip portion and a center of said fixing nip portion satisfies $0\ (\text{mm}) < d <= 80\ (\text{mm})$, and wherein assuming that an angle formed by said shortest straight line and said recording material passing through said transfer nip portion is $\phi s$ (rad) when said detection means detects the loop state, a distance between the center of said transfer nip portion and a position nearest to said recording material of said electrode member is j (mm) in a direction of said angle $\phi s$ (rad), and a time between a time when said detection means detects the loop state and a time when the speed at which said recording material is sandwiched and conveyed by said fixing means is switched by said switch means is Tk, said speed Tk satisfies $Tk+(V-Vw)\times Tk/Vh+Tk+(Vh-V)\times Tk/Vw>=0.5$ (sec), and said angle $\phi$ satisfies $0<j\times(ACOS(d/(d/COS(\phi s)+(Vh-V)\times Tk))-ACOS(d/(d/COS(\phi s)+(Vw-V)\times Tk)<=1$ (mm), where ACOS is an inverse function of COS.

5. An image forming apparatus according to claim 4, wherein the loop state, detected by said detection means, of said recording material is a size of the loop of said recording material.

6. An image forming apparatus according to claim 5, wherein said switch means switches the speed at which said recording material is sandwiched and conveyed by the fixing means to said first speed when the loop of said recording material is larger than a predetermined size, and said switch means switches the speed at which said recording material is sandwiched and conveyed by the fixing means to said second speed when the loop of said recording material is smaller than the predetermined size.

* * * * *